US011447949B2

(12) United States Patent
Honarbakhsh et al.

(10) Patent No.: US 11,447,949 B2
(45) Date of Patent: Sep. 20, 2022

(54) FRICTION DAMPER FOR A BUILDING STRUCTURE

(71) Applicants: Teymour Honarbakhsh, Tehran (IR); Babak Esmailzadeh Hakimi, Tehran (IR)

(72) Inventors: Teymour Honarbakhsh, Tehran (IR); Babak Esmailzadeh Hakimi, Tehran (IR)

(73) Assignee: BEHSAZAN SAZEH SARZAMIN, Tehran (IR)

( * ) Notice: Subject to any disclaimer, the term of this patent is extended or adjusted under 35 U.S.C. 154(b) by 0 days.

(21) Appl. No.: 17/176,189

(22) Filed: Feb. 16, 2021

(65) Prior Publication Data

US 2021/0164223 A1 Jun. 3, 2021

Related U.S. Application Data

(60) Provisional application No. 62/977,294, filed on Feb. 16, 2020.

(51) Int. Cl.
*E04B 1/98* (2006.01)
*E04H 9/02* (2006.01)

(52) U.S. Cl.
CPC ..... *E04B 1/98* (2013.01); *E04H 9/0215* (2020.05); *E04H 9/0235* (2020.05)

(58) Field of Classification Search
CPC ..... E04B 1/98; E04H 9/0215; E04H 9/0235; E04H 9/0237
See application file for complete search history.

(56) References Cited

U.S. PATENT DOCUMENTS 4,409,765 A * 10/1983 Pall ..... E04H 9/0237 52/573.1
4,531,334 A * 7/1985 Nylander ..... E04B 1/98 52/109

(Continued)

FOREIGN PATENT DOCUMENTS

JP 2003506597 A * 2/2003
JP 2006125189 A * 5/2006 ..... E04H 9/02

(Continued)

OTHER PUBLICATIONS

International Search Report and Written Opinion for PCT/IB2021/051283 (7 pages). (dated 2021).*

*Primary Examiner* — Rodney Mintz
(74) *Attorney, Agent, or Firm* — Bajwa IP Law Firm; Haris Zaheer Bajwa

(57) ABSTRACT

A friction damper for attenuating vibrations of a structure. The friction damper includes a first connecting member configured to be attached to a first member of the structure, a second connecting member configured to be attached to a second member of the structure, a first slotted-bar interconnected between the first connecting member and the second connecting member, and a second slotted-bar interconnected between the first connecting member and the second connecting member. The first slotted-bar and the second-slotted bar are configured to allow horizontal and vertical movements of the first connecting member and the second connecting member relative to each other responsive to vibration of the structure.

7 Claims, 11 Drawing Sheets

(56) References Cited

U.S. PATENT DOCUMENTS 5,845,438 A * 12/1998 Haskell ..... E04H 9/0237 52/167.3
6,651,395 B2 * 11/2003 Capra ..... E04H 9/0237 52/167.3
6,672,573 B2 * 1/2004 Berton ..... E04H 9/0235 267/136
6,840,016 B1 * 1/2005 Mualla ..... F16F 7/04 52/167.6
8,677,699 B2 * 3/2014 Tagawa ..... E04H 9/0237 188/380
8,807,307 B2 * 8/2014 Choi ..... E04H 9/0237 248/562
9,260,860 B2 * 2/2016 Mualla ..... E04B 1/98
9,580,924 B1 * 2/2017 Taylor ..... E04H 9/028
9,689,173 B2 * 6/2017 Wu ..... E04H 9/0237
10,125,511 B2 * 11/2018 Stefani ..... E04H 9/023
10,323,430 B1 * 6/2019 Pall ..... E04H 9/024
10,563,418 B2 * 2/2020 Pall ..... E04H 9/024
10,995,510 B2 * 5/2021 Lo Ricco ..... E04B 5/43
2001/0054785 A1 * 12/2001 Berton ..... E04H 9/0237 267/136
2002/0011037 A1 * 1/2002 Capra ..... E04H 9/0237 52/167.2
2002/0129568 A1 * 9/2002 Oka ..... E04H 9/0237 52/167.3
2005/0115170 A1 * 6/2005 Mualla ..... E04H 9/0237 52/167.1
2012/0038091 A1 * 2/2012 Tagawa ..... E04H 9/0237 267/136
2012/0138402 A1 * 6/2012 Choi ..... F16F 7/08 188/381
2012/0260585 A1 * 10/2012 Mualla ..... E04B 1/98 52/167.1
2014/0174002 A1 * 6/2014 Mualla ..... E04B 1/98 52/167.1
2015/0135611 A1 * 5/2015 Beard ..... E04H 9/024 52/167.3
2015/0184413 A1 * 7/2015 Pryor ..... E04C 3/04 52/167.3
2017/0058514 A1 * 3/2017 Wu ..... E04H 9/0237
2017/0284119 A1 * 10/2017 Stefani ..... E04H 9/023
2019/0186165 A1 * 6/2019 Pall ..... E04B 1/92
2019/0383053 A1 * 12/2019 Pall ..... E04H 9/024
2020/0095794 A1 * 3/2020 Lo Ricco ..... E04B 9/22
2020/0392718 A1 * 12/2020 Frazao ..... E04H 9/0237
2021/0156164 A1 * 5/2021 Ausenda ..... E02D 27/34

FOREIGN PATENT DOCUMENTS

JP 3898732 B2 * 3/2007 ..... E04H 9/02
WO WO-0109466 A1 * 2/2001 ..... E04H 9/02
WO WO-2011099816 A2 * 8/2011 ..... E04H 9/02

* cited by examiner

207

FRICTION DAMPER FOR A BUILDING STRUCTURE

CROSS-REFERENCE TO RELATED APPLICATION

This application claims the benefit of priority from pending U.S. Provisional Patent Application Ser. No. 62/977,294, filed on Feb. 16, 2020, and entitled "SLIPPING-ROTATIONAL FRICTION DAMPER" which is incorporated herein by reference in its entirety.

TECHNICAL FIELD

The present disclosure generally relates to the protection of structural systems against dynamic loadings such as loading caused by earthquakes and winds, and particularly relates to a friction damper for protecting structures against dynamic loadings such as loadings caused by an earthquake.

BACKGROUND

Modern buildings, using typical construction components such as reinforced concrete shear walls, structural steel braced frames, structural steel or reinforced concrete moment frames, or combinations thereof may have low inherent damping properties. Due to this low inherent damping feature, high-rise buildings, in particular, may tend to be susceptible to excessive vibrations caused by dynamic loads such as loadings caused by an earthquake. Excessive accelerations and torsional velocities may cause occupant discomfort, while excessive displacements may cause damage to non-structural and structural elements. For this reason, it may be advantageous to provide additional sources of damping to control these excessive vibrations and reduce the overall building response to dynamic loads.

Currently available systems for controlling displacement, forces, velocities, and accelerations in such structures consists of passive systems such as supplemental dampers and vibrational absorbers as well as active systems. Dampers play an important role in protecting a building construction, for example, a house or the like, and exist in numerous modified forms.

Dampers typically dampen motion by utilizing a frictional force between two moving parts attached between structural members of the building or by utilizing a fluid being pressed to flow between two chambers through a restricted tube. Some dampers may be active dampers that actively change an attenuation effect corresponding to an external state, while others may be passive dampers that may have predetermined attenuating characteristics.

However, conventional dampers are costly and much higher costs are required in equipping members of a building construction with dampers. In addition, when frictional plates mounted to offer a frictional force are abraded, the frictional plates capable of attenuating a vibration may be functionally degraded and the entire damper structure would need to be replaced, thereby resulting in increased maintenance and replacement costs.

Also, providing structures with appropriate safety and performance level during strong motion of earthquakes is the main target of clients/designers in areas with high seismicity which may increase the cost of projects. In order to achieve seismic design objectives, different friction based energy dissipating devices with various mechanisms have been developed. The usage of these devices may be limited to particular sort of bracings (some for chevron and some for "x"/diagonal type) and generally may impose restrictions to the design and may increase cost of the projects which may prevent them from being appropriate for wide range of buildings.

There is, therefore, a need for a non-expensive and simple frictional damper that is able to attenuate vibrations of a structure such as a building caused by an external dynamic source such as an earthquake or a wind. There is also a need for a mechanism which is able to cover both shear and axial behavior which may make a damper suitable for a wide range of structures and bracing systems and also may make the design process to get free from device-induced restrictions and limitations.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments of the present disclosure, a friction damper for attenuating vibrations of a structure is disclosed. In an exemplary embodiment, the friction damper may include a first connecting member, a second connecting member, a first slotted-bar, and a second slotted-bar. In an exemplary embodiment, the first connecting member may be configured to be attached to a first member of the structure. In an exemplary embodiment, the second connecting member may be configured to be attached to a second member of the structure.

In an exemplary embodiment, the first slotted-bar may be interconnected between the first connecting member and the second connecting member. In an exemplary embodiment, a first end of the first slotted-bar may be attached rotatably to the first connecting member. In an exemplary embodiment, a second end of the first slotted-bar may be attached rotatably and slidably to the second connecting member.

In an exemplary embodiment, the second slotted-bar may be interconnected between the first connecting member and the second connecting member. In an exemplary embodiment, the first end of the second slotted-bar may be attached rotatably to the first connecting member. In an exemplary embodiment, the second end of the second slotted bar may be attached rotatably and slidably to the second connecting member. In an exemplary embodiment, the first slotted-bar and the second-slotted bar may be configured to allow horizontal and vertical movements of the first connecting member and the second connecting member relative to each other responsive to vibration of the structure.

In an exemplary embodiment, the first end of the first slotted-bar may be attached rotatably to a first end of the first connecting member. In an exemplary embodiment, the first end of the second slotted-bar may be attached rotatably to a second end of the first connecting member. In an exemplary embodiment, the second end of the second slotted-bar may be attached rotatably and slidably to a first end of the second connecting member. In an exemplary embodiment, the second end of the first slotted-bar may be attached rotatably and slidably to a second end of the second connecting member.

In an exemplary embodiment, the first end of the first connecting member may be in front of the first end of the second connecting member and the second end of the first connecting member may be in front of the second end of the second connecting member. In an exemplary embodiment, a main longitudinal axis of the first slotted-bar may intersect a projection of a main longitudinal axis of the second slotted-bar on a main plane of the first slotted-bar. In an exemplary embodiment, the main longitudinal axis of the first slotted-bar may coincide with a longest dimension of the first slotted-bar. In an exemplary embodiment, the main longitudinal axis of the second slotted-bar may coincide with a longest dimension of the second slotted-bar. In an exemplary embodiment, the main plane of the first slotted-bar may coincide with a largest surface of the first slotted-bar and passing through the main longitudinal axis of the first slotted-bar.

In an exemplary embodiment, the second end of the first slotted-bar may be attached rotatably and slidably to the second end of the second connecting member utilizing a first slider mechanism. In an exemplary embodiment, the first slider mechanism may include a first pin and a first pin receiving slot at the second end of the first slotted-bar. In an exemplary embodiment, the first pin may be attached to the second end of the second connecting member.

In an exemplary embodiment, the first pin may be disposed slidably inside the first pin receiving slot. In an exemplary embodiment, the second end of the second slotted-bar may be attached rotatably and slidably to the first end of the second connecting member utilizing a second slider mechanism. In an exemplary embodiment, the second slider mechanism may include a second pin and a second pin receiving slot at the second end of the second slotted-bar. In an exemplary embodiment, the second pin attached to the first end of the second connecting member. In an exemplary embodiment, the second pin may be disposed slidably inside the second pin receiving slot.

In an exemplary embodiment, the first end of the first slotted-bar may be attached rotatably to the first end of the first connecting member utilizing a first pin mechanism. In an exemplary embodiment, the first pin mechanism may include a third pin and a first pin receiving hole at the first end of the first slotted-bar. In an exemplary embodiment, the third pin may be disposed inside the first pin receiving hole. In an exemplary embodiment, the first end of the second slotted-bar may be attached rotatably to the second end of the first connecting member utilizing a second pin mechanism. In an exemplary embodiment, the second pin mechanism may include a fourth pin and a second pin receiving hole at the first end of the second slotted-bar. In an exemplary embodiment, the fourth pin may be disposed inside the second pin receiving hole.

In an exemplary embodiment, the friction damper may include a first frictional mechanism. In an exemplary embodiment, the first frictional mechanism may be configured to resist against movement of the first slotted-bar relative to the second member through arising a first friction force between the first frictional mechanism and the first slotted-bar.

In an exemplary embodiment, the first frictional mechanism may include a first frictional member mounted onto the third pin and adjacent to the first slotted-bar. In an exemplary embodiment, the first frictional member may be configured to arise the first friction force between the first slotted-bar and the first frictional member responsive to movement of the first slotted-bar.

In an exemplary embodiment, the first frictional mechanism may further include a first fastening member mounted onto the third pin and adjacent to the first frictional member. In an exemplary embodiment, the first fastening member may be configured to secure the first frictional member constantly in contact with the first slotted-bar.

In an exemplary embodiment, the friction damper may further include a second frictional mechanism. In an exemplary embodiment, the second frictional mechanism may be configured to resist against movement of the second slotted-bar through arising a second friction force between the second frictional mechanism and the second slotted-bar.

In an exemplary embodiment, the second frictional mechanism may include a second frictional member. In an exemplary embodiment, the second frictional member may be mounted onto the fourth pin and adjacent to the second slotted-bar. In an exemplary embodiment, the second frictional member may be configured to arise the second friction force between the second slotted-bar and the second frictional member responsive to movement of the first slotted-bar.

In an exemplary embodiment, the second frictional mechanism may include a second fastening member. In an exemplary embodiment, the second fastening member may be mounted onto the fourth pin and adjacent to the second frictional member. In an exemplary embodiment, the second fastening member may be configured to secure the second frictional member constantly in contact with the second slotted-bar.

In an exemplary embodiment, the first connecting member may include a first horizontal plate and a first vertical plate. In an exemplary embodiment, the first horizontal plate may be configured to be attached to the first member of the structure from a top surface of the first horizontal plate. In an exemplary embodiment, the first vertical plate may be attached to a bottom surface of the first horizontal plate.

In an exemplary embodiment, the second connecting member may include a second horizontal plate and a second vertical plate. In an exemplary embodiment, the second horizontal plate may be configured to be attached to the second member of the structure from a bottom surface of the second horizontal plate. In an exemplary embodiment, the second vertical plate may be attached to a top surface of the second horizontal plate. In an exemplary embodiment, the top surface of the second horizontal places and the bottom surface of the first horizontal plate face toward each other.

In an exemplary embodiment, a first side of the first vertical plate may be aligned with a first side of the second vertical plate. In an exemplary embodiment, a second side of the first vertical plate may be aligned with a second side of the second vertical plate. In an exemplary embodiment, the first slotted-bar may be attached to the first side of the first vertical plate and the first side of the second vertical plate. In an exemplary embodiment, the second slotted-bar may be attached to the second side of the first vertical plate and the second side of the second vertical plate.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed an exemplary friction damper for attenuating vibrations of a structure such as a building or a bridge. An exemplary friction damper includes two connecting members. Each of the connecting members may be attached to a member of a building or another structure such as a bridge. For example, one of the two connecting members may be attached to a beam of a building structure and the other connecting member of the two connecting members may be attached to a bracing member of the building structure. Each of the two connecting members may have two pins at its two ends. Two slotted-bars may be interconnected between the two connecting members in an "X" shape as a cross arrangement. One end of each of the two slotted-bars may have a slot and the other end of each of the two slotted bars may have a hole. Each of the two slotted-bars may be mounted on connecting members in such a way that a pin at one end of one of the two connecting members is disposed inside the hole of the slotted-bar and a pin at the other end of the other connecting member of the two connecting members is disposed inside the slot of the slotted-bar. This arrangement of the connecting members and the slotted-bars may attenuate vibrations of a structure such as a building or a bridge caused by an external dynamic source such as an earthquake or a wind.

Figure 1A:
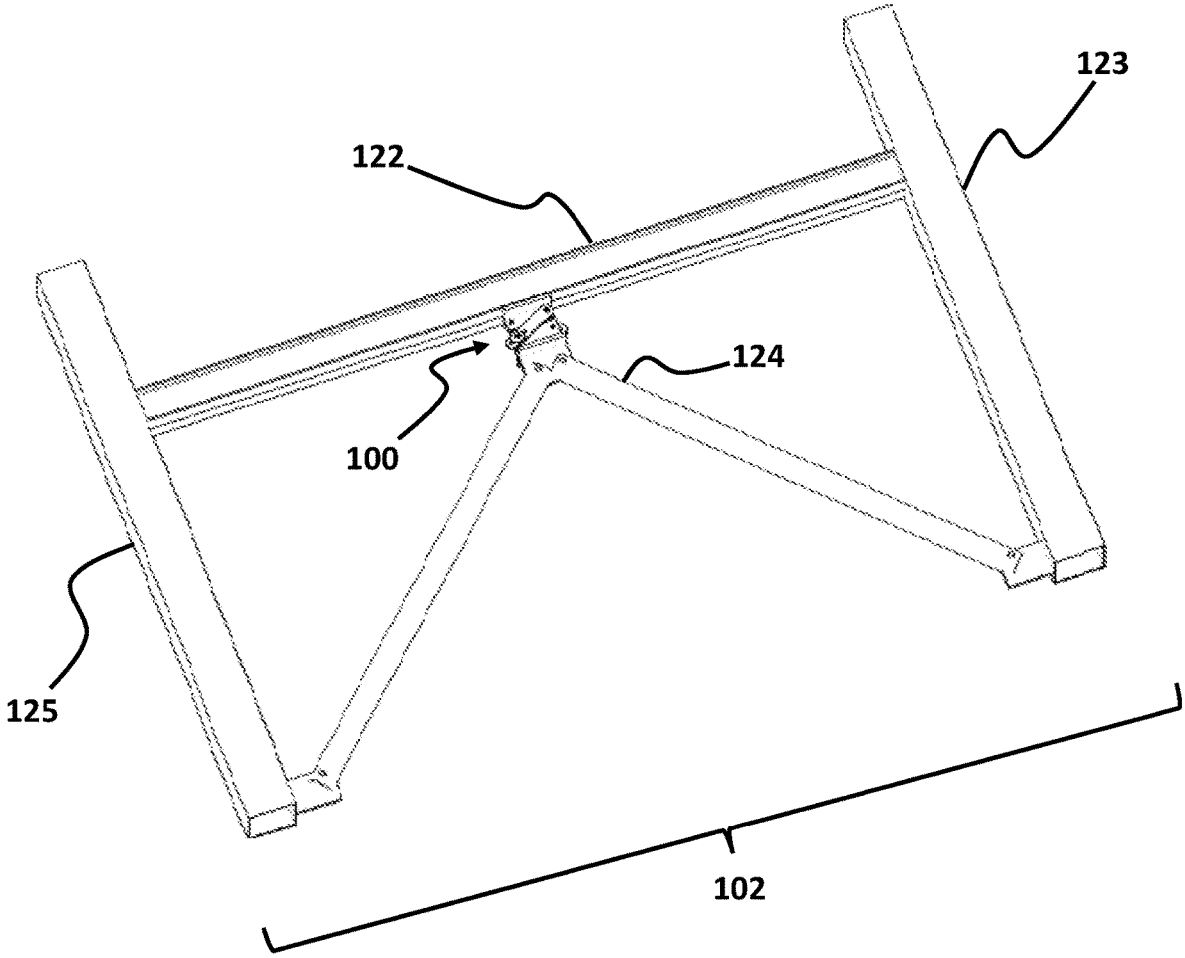
FIG. 1A illustrates a perspective view of an exemplary friction damper in a scenario in which the friction damper is installed onto a structure, consistent with one or more exemplary embodiments of the present disclosure.
Figure 1B:
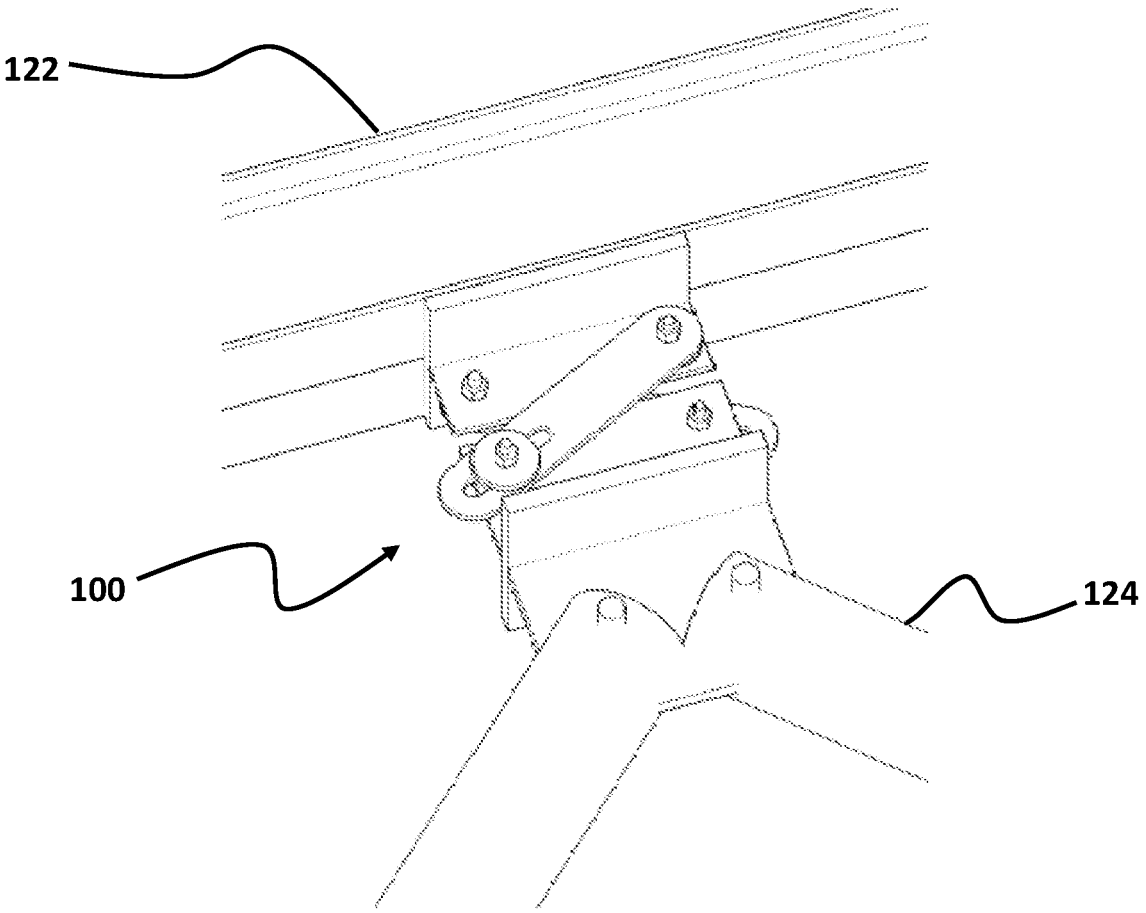
FIG. 1B illustrates a view of an exemplary friction damper in a scenario in which the friction damper is installed onto a structure, consistent with one or more exemplary embodiments of the present disclosure.
Figure 1C:
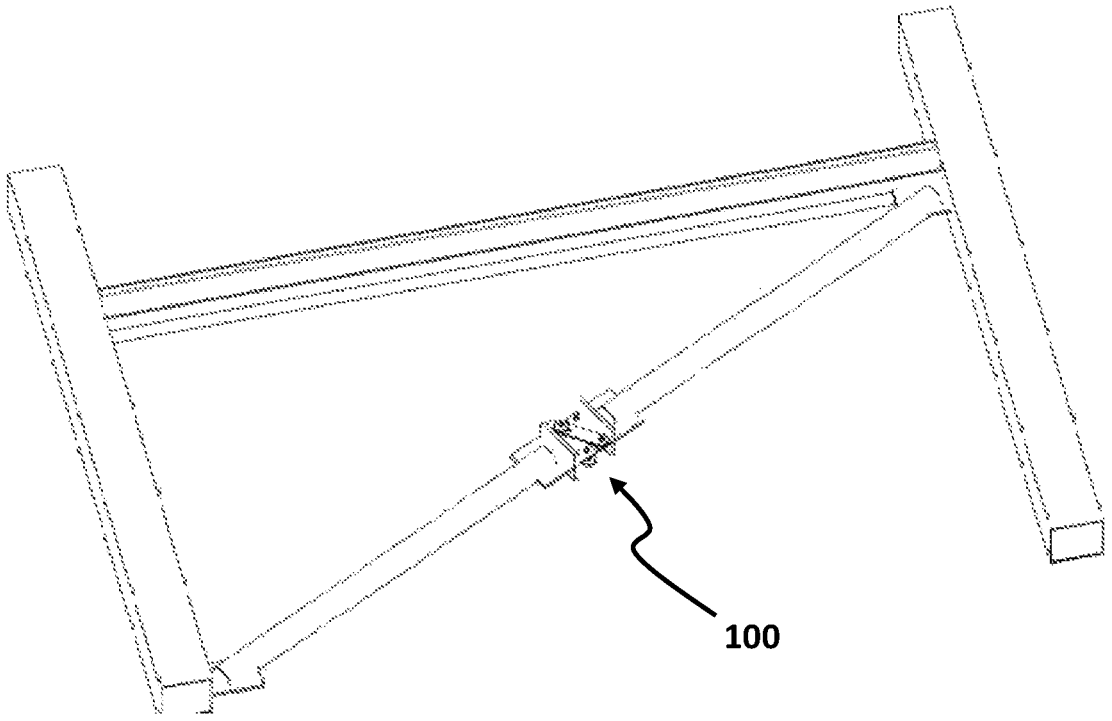
FIG. 1C illustrates a view of an exemplary friction damper in a scenario in which the friction damper is installed onto another structure, consistent with one or more exemplary embodiments of the present disclosure.
Figure 1D:
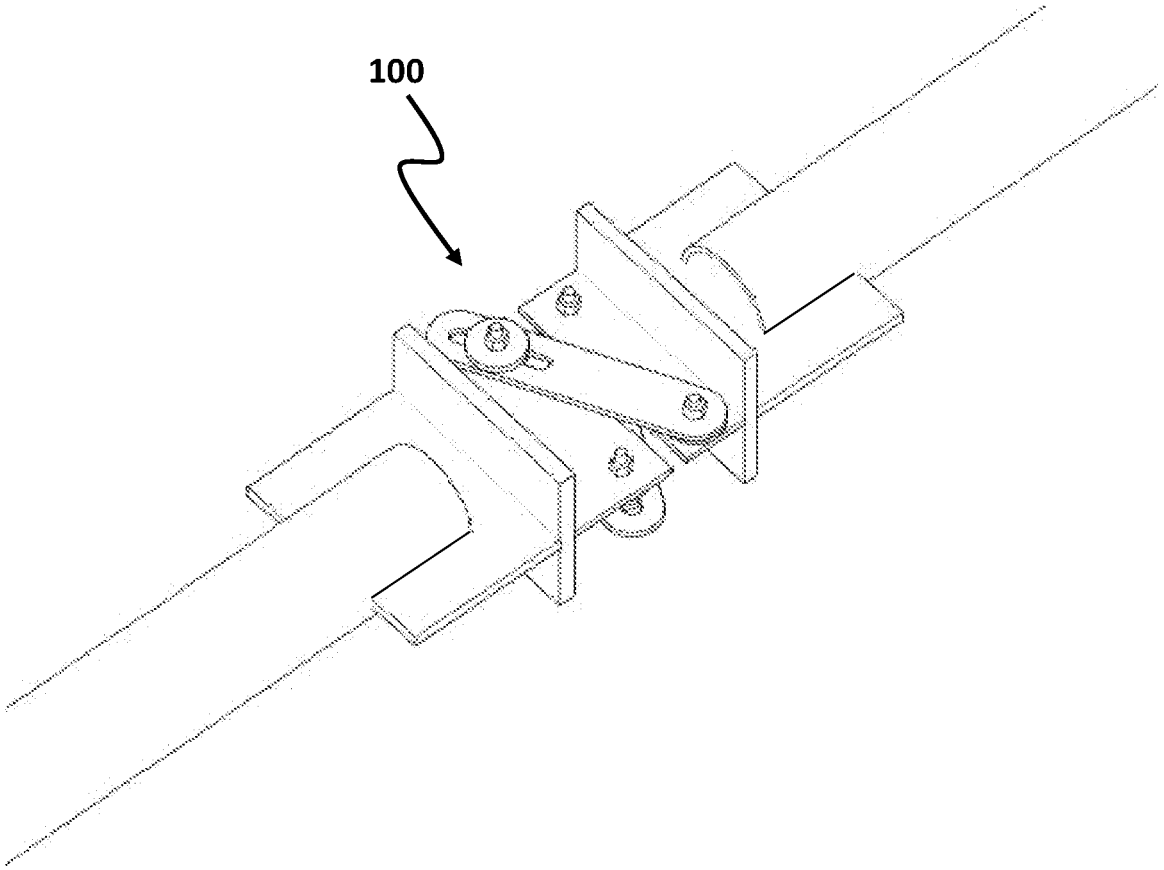
FIG. 1D illustrates a view of an exemplary friction damper in a scenario in which the friction damper is installed onto the another structure, consistent with one or more exemplary embodiments of the present disclosure.

FIG. 1A shows a perspective view of an exemplary friction damper 100 in a scenario in which friction damper 100 is installed onto a structure, consistent with one or more exemplary embodiments of the present disclosure. FIG. 1B shows a perspective view of exemplary friction damper 100 in a scenario in which friction damper 100 is installed onto a structure, consistent with one or more exemplary embodiments of the present disclosure. FIG. 1C shows a perspective view of exemplary friction damper 100 in a scenario in which friction damper 100 is installed onto another structure, consistent with one or more exemplary embodiments of the present disclosure. FIG. 1D shows a perspective view of exemplary friction damper 100 in a scenario in which friction damper 100 is installed onto the other structure, consistent with one or more exemplary embodiments of the present disclosure. As shown in FIG. 1A and FIG. 1B, in an exemplary embodiment, friction damper 100 may be connected between a first member 122 of a structure 102 and a second member 124 of structure 102. In an exemplary embodiment, structure 102 may refer to a building construction which may include a plurality of horizontal beams such as first member 122, a plurality of vertical columns such as a first vertical column 123 and a second vertical column 125, and a plurality of bracing members such as a second member 124. In an exemplary embodiment, first member 122 may be interconnected between first column 123 and second column 125. In an exemplary embodiment, first member 122 may be interconnected between first column 123 and second column 125 in such a way that a main longitudinal axis of first member 122 is perpendicular to a main longitudinal axis of first column 123 and a main longitudinal axis of second column 125. In an exemplary embodiment, a bracing member may refer to a member that may be connected between horizontal beams and vertical columns of a structure in order to provide stability for horizontal beams and vertical columns of the structure and help horizontal beams and vertical columns to resist against lateral loads.

Figure 2A:
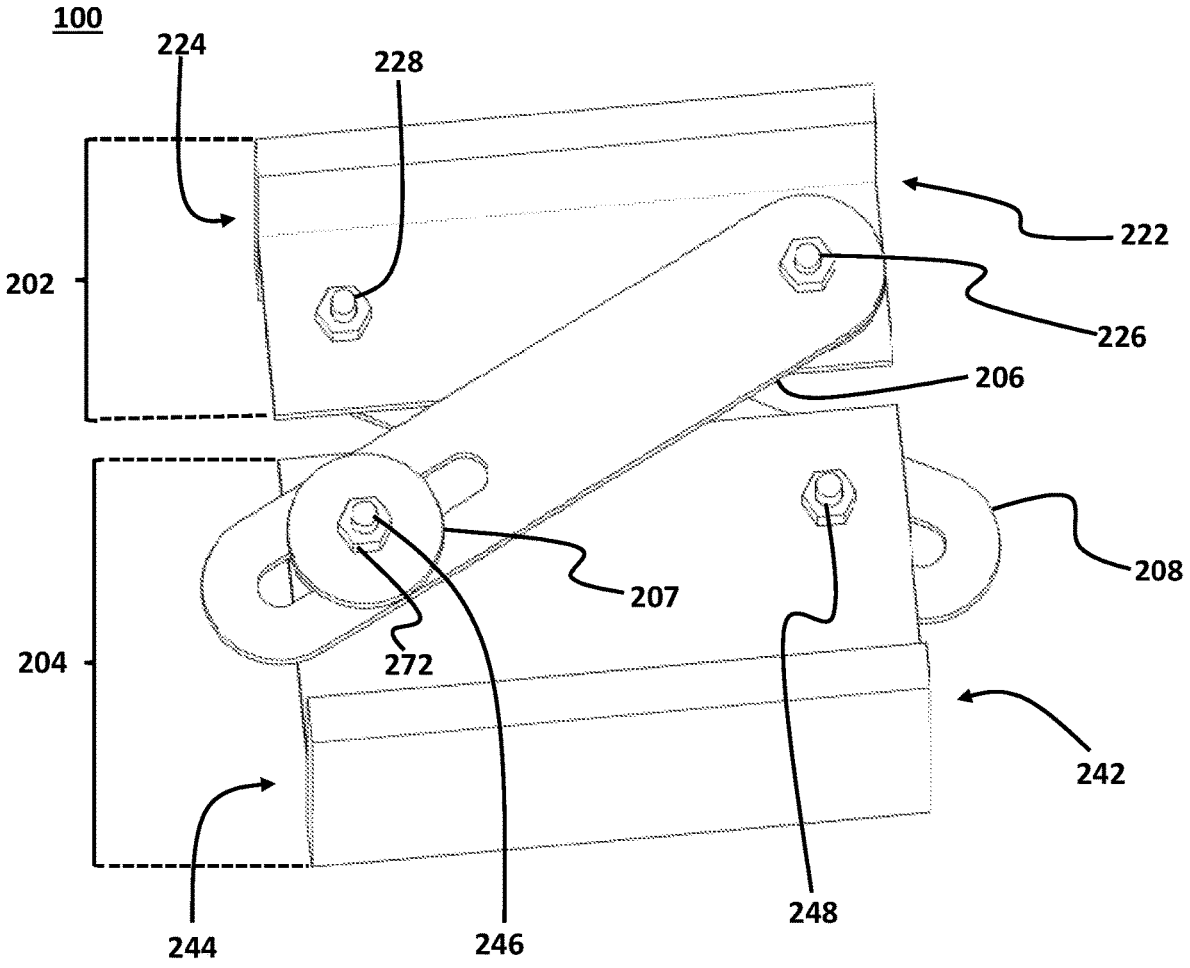
FIG. 2A illustrates a perspective view of an exemplary friction damper, consistent with one or more exemplary embodiments of the present disclosure.
Figure 2B:
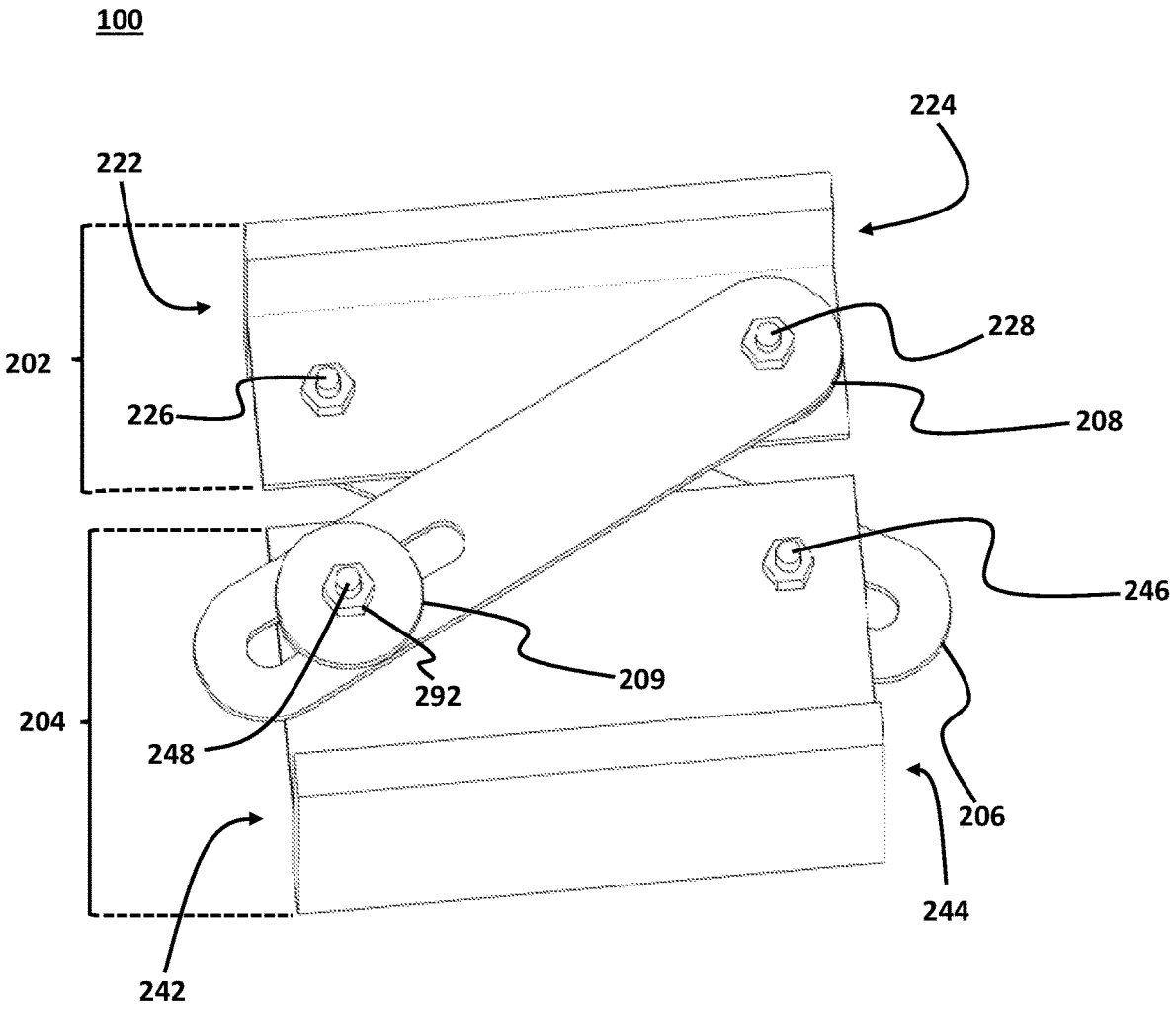
FIG. 2B illustrates a back view of an exemplary friction damper, consistent with one or more exemplary embodiments of the present disclosure.
Figure 2C:
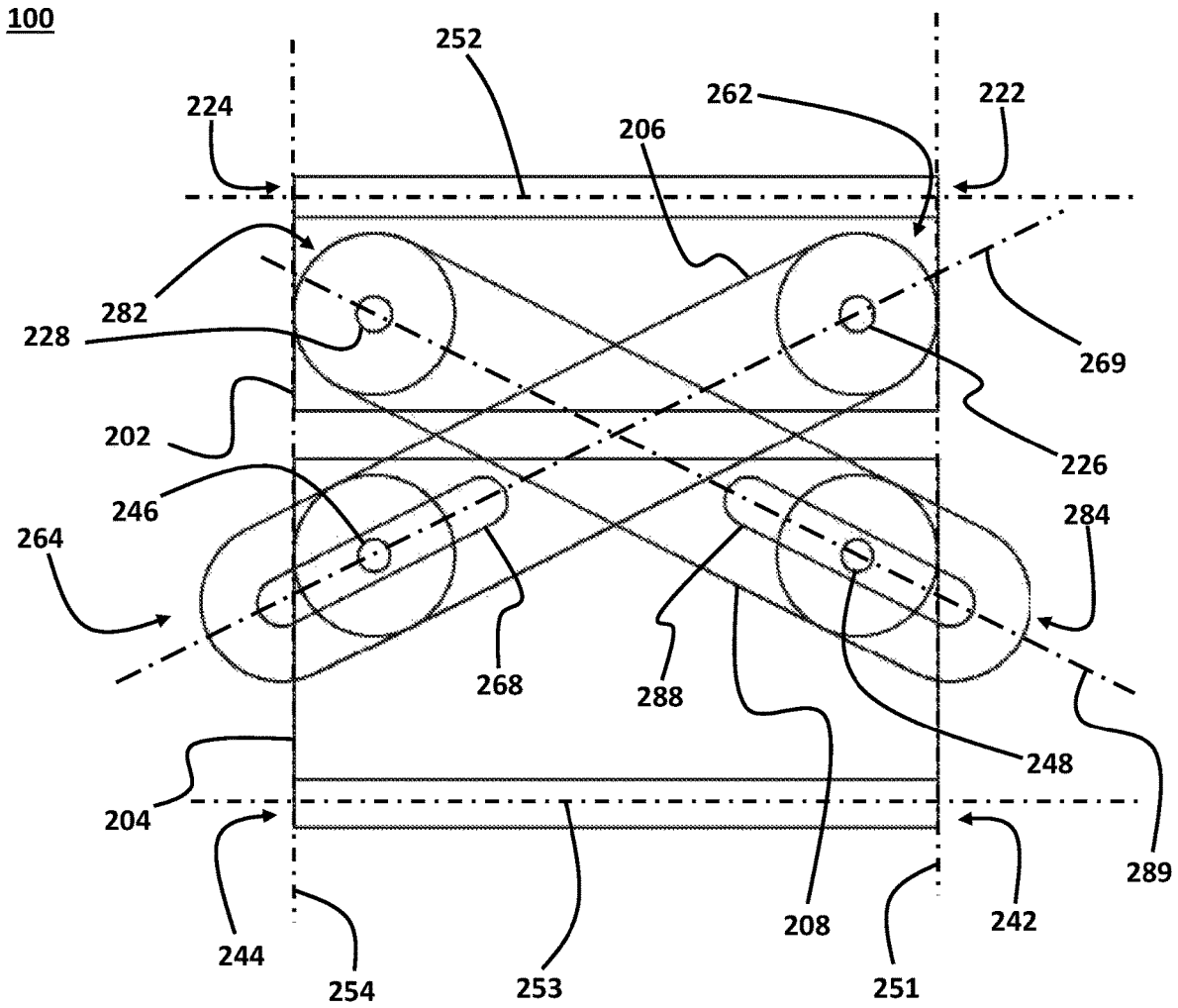
FIG. 2C illustrates a schematic front view of an exemplary friction damper, consistent with one or more exemplary embodiments of the present disclosure.
Figure 2D:
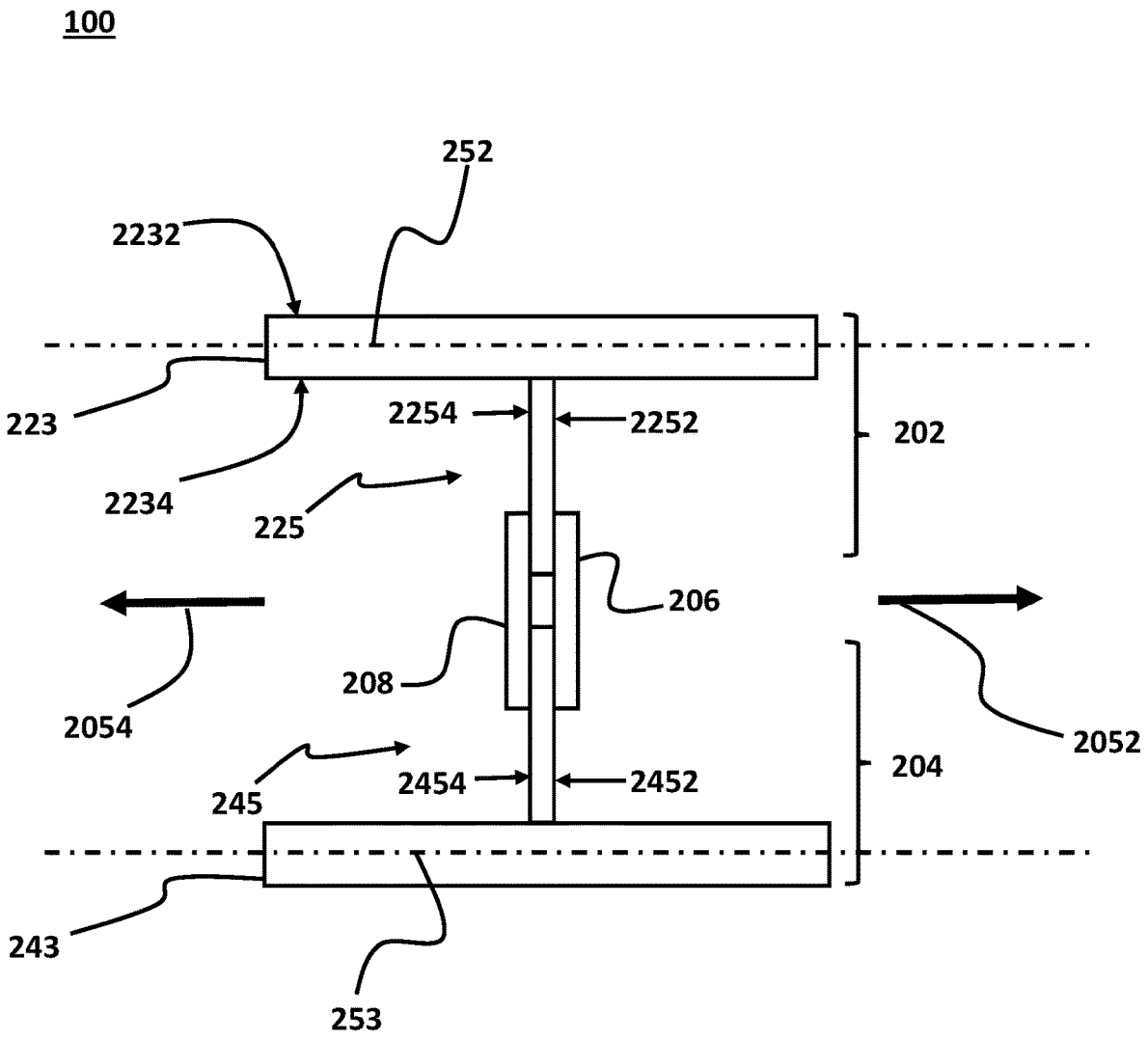
FIG. 2D illustrates a side view of an exemplary friction damper, consistent with one or more exemplary embodiments of the present disclosure.

FIG. 2A shows a perspective view of friction damper 100, consistent with one or more exemplary embodiments of the present disclosure. FIG. 2B shows a back view of friction damper 100, consistent with one or more exemplary embodiments of the present disclosure. FIG. 2C shows a schematic front view of friction damper 100, consistent with one or more exemplary embodiments of the present disclosure. FIG. 2D shows a side view of friction damper 100, consistent with one or more exemplary embodiments of the present disclosure. As shown in FIG. 2A, FIG. 2B, and FIG. 2C, in an exemplary embodiment, friction damper 100 may include a first connecting member 202 and a second connecting member 204. In an exemplary embodiment, first connecting member 202 may be connected to first member 122. In an exemplary embodiment, second connecting member 204 may be connected to second member 124 of structure 102.

Figure 2E:
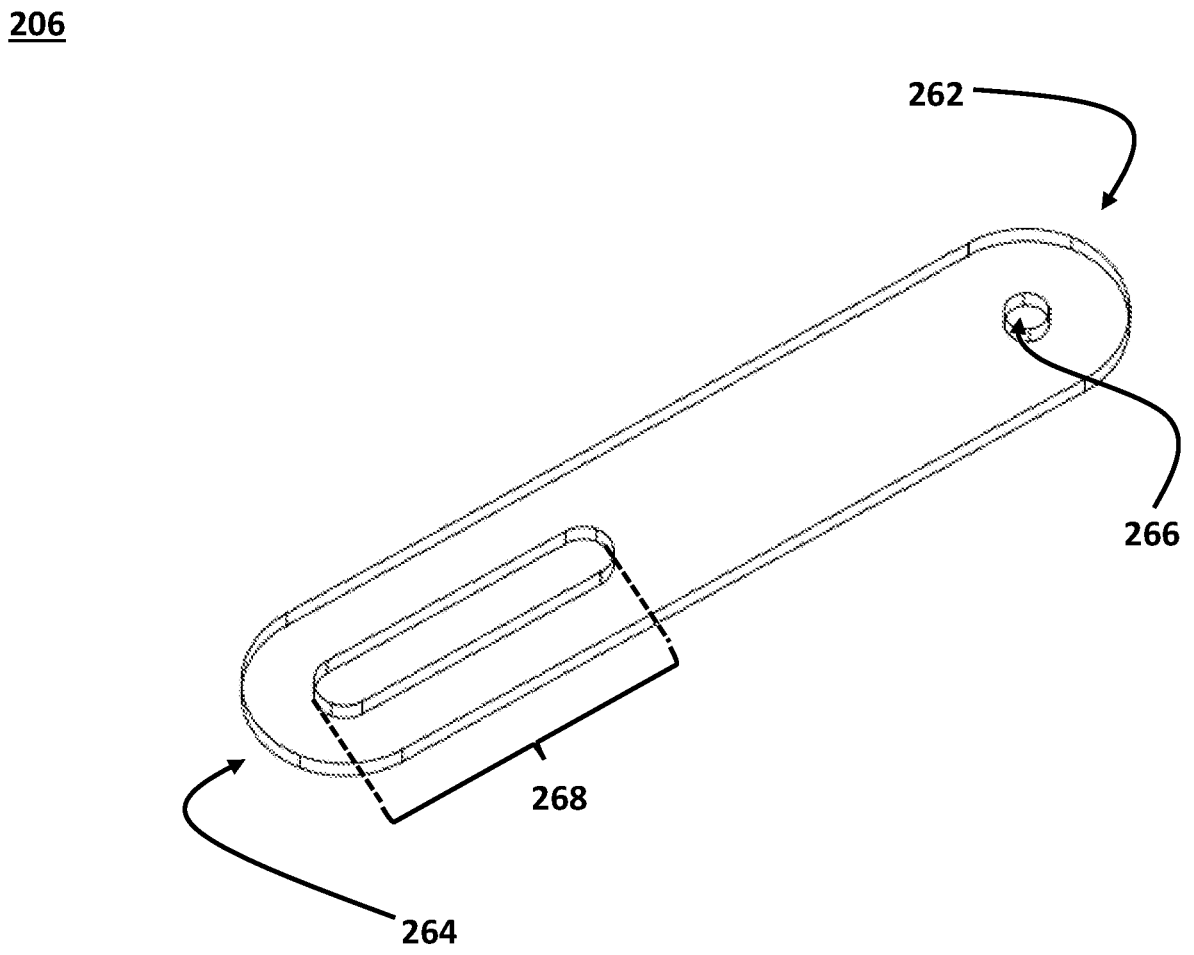
FIG. 2E illustrates an exemplary first slotted-bar, consistent with one or more exemplary embodiments of the present disclosure.
Figure 2F:
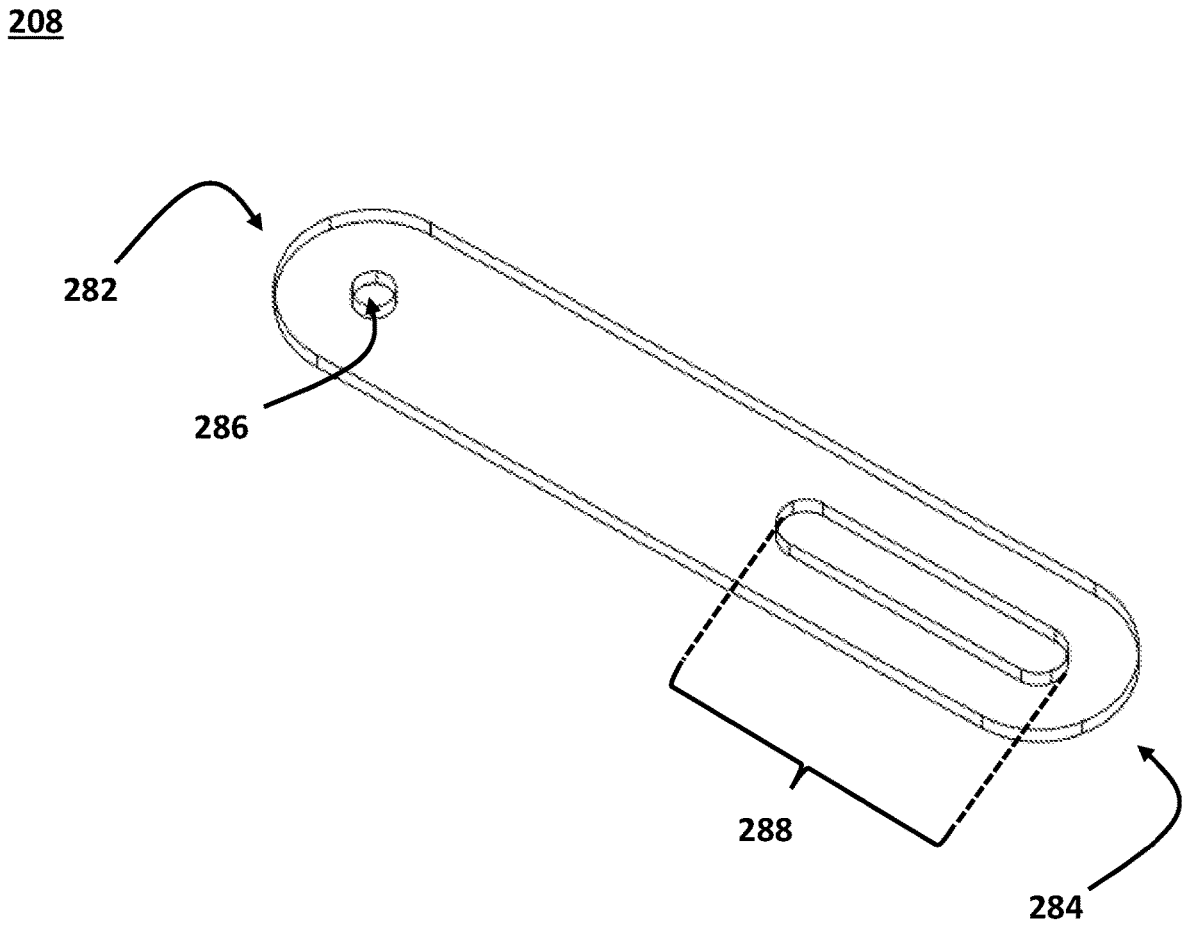
FIG. 2F illustrates an exemplary second slotted-bar, consistent with one or more exemplary embodiments of the present disclosure

As further shown in FIG. 2A, FIG. 2B, and FIG. 2C, in an exemplary embodiment, friction damper 100 may further include a first slotted-bar 206 and a second slotted-bar 208. FIG. 2E shows first slotted-bar 206, consistent with one or more exemplary embodiments of the present disclosure. FIG. 2F shows second slotted-bar 208, consistent with one or more exemplary embodiments of the present disclosure. In an exemplary embodiment, first slotted-bar 206 and second slotted-bar 208 may be interconnected between first connecting member 202 and second connecting member 204. In an exemplary embodiment, first slotted-bar 206 may include a first pin receiving hole 266 at a first end 262 of first slotted-bar 206. In an exemplary embodiment, first slotted-bar 206 may include a first pin receiving hole 266 at a first end 262 of first slotted-bar 206. In an exemplary embodiment, first slotted-bar 206 may include a first slot 268 at a second end 264 of first slotted-bar 206. In an exemplary embodiment, first pin receiving hole 266 may include a thorough hole. In an exemplary embodiment, a thorough hole may refer to a hole that both ends thereof are open. In an exemplary embodiment, first slot 268 may include a thorough slot. In an exemplary embodiment, a thorough slot may refer to a slot that both ends thereof are open. In an exemplary embodiment, second slotted-bar 208 may include a second pin receiving hole 286 at a first end 282 of second slotted-bar 208. In an exemplary embodiment, second slotted-bar 208 may include a second pin receiving hole 286 at a first end 282 of second slotted-bar 208. In an exemplary embodiment, second slotted-bar 208 may include a second slot 288 at a second end 284 of second slotted-bar 208. In an exemplary embodiment, second pin receiving hole 286 may include a thorough hole. In an exemplary embodiment, a thorough hole may refer to a hole that both ends thereof are open. In an exemplary embodiment, second slot 288 may include a thorough slot. In an exemplary embodiment, a thorough slot may refer to a slot that both ends thereof are open.

As shown in FIG. 2D, in an exemplary embodiment, first connecting member 202 may include a first horizontal plate 223. In an exemplary embodiment, first horizontal plate 223 may be attached from a top surface 2232 of first horizontal plate 223 to first member 122. In an exemplary embodiment, first horizontal plate 223 may be attached from a top surface 2232 of first horizontal plate 223 to first member 122 utilizing a welding method. In an exemplary embodiment, first connecting member 202 may further include a first vertical plate 225. In an exemplary embodiment, first vertical plate 225 may be attached to a bottom surface 2234 of first horizontal plate 223. In an exemplary embodiment, second connecting member 204 may include a second horizontal plate 243. In an exemplary embodiment, second horizontal plate 243 may be attached from a bottom surface 2432 of second horizontal plate 243 to second member 124. In an exemplary embodiment, second horizontal plate 243 may be attached from a bottom surface 2432 of second horizontal plate 243 to second member 124 utilizing a welding method. In an exemplary embodiment, second connecting member 204 may further include a second vertical plate 245. In an exemplary embodiment, second vertical plate 245 may be attached to a top surface 2434 of second horizontal plate 243. In an exemplary embodiment, first slotted-bar 206 may be connected to a first side 2252 of first vertical plate 225 and a first side 2452 of second vertical plate 245. In an exemplary embodiment, second slotted-bar 208 may be connected to a second side 2254 of first vertical plate 225 and a second side 2454 of second vertical plate 245. In an exemplary embodiment, first side 2252 of first vertical plate 225 and first side 2452 of second vertical plate 245 may face toward a same first direction 2052. In an exemplary embodiment, second side 2254 of first vertical plate 225 and second side 2454 of second vertical plate 245 may face toward a same second direction 2054. In an exemplary embodiment, first direction 2052 and second direction 2054 may be opposite to each other.

In an exemplary embodiment, a first end 262 of first slotted-bar 206 may be attached rotatably to first connecting member 202. In an exemplary embodiment, it may be understood that when first end 262 of first slotted-bar 206 is attached rotatably to first connecting member 202, it may mean that first end 262 of first slotted-bar 206 is attached to first connecting member 202 in such a way that first slotted-bar 206 may be able to have rotational movement relative to first connecting member 202. In an exemplary embodiment, a second end 264 of first slotted-bar 206 may be attached rotatably and slidably to second connecting member 204. In an exemplary embodiment, it may be understood that when second end 264 of first slotted-bar 206 is attached rotatably and slidably to second connecting member 204, it may mean that second end 264 of first slotted-bar 206 is attached to second connecting member 204 in such a way that first slotted-bar 206 may be able to have both rotational movement and linear movement relative to second connecting member 204.

In an exemplary embodiment, a first end 282 of second slotted-bar 208 may be attached rotatably to first connecting member 202. In an exemplary embodiment, it may be understood that when first end 282 of second slotted-bar 208 is attached rotatably to first connecting member 202, it may mean that first end 282 of second slotted-bar 208 is attached to first connecting member 202 in such a way that second slotted-bar 208 may be able to have rotational movement relative to first connecting member 202. In an exemplary embodiment, a second end 284 of second slotted-bar 208 may be attached rotatably and slidably to second connecting member 204. In an exemplary embodiment, it may be understood that when second end 284 of second slotted-bar 208 is attached rotatably and slidably to second connecting member 204, it may mean that second end 284 of second slotted-bar 208 is attached to second connecting member 204 in such a way that second slotted-bar 208 may be able to have both rotational movement and linear movement relative to second connecting member 204.

Referring back to FIG. 2C, in an exemplary embodiment, first slotted-bar 206 and second slotted-bar 208 may be interconnected diagonally between first connecting member 202 and second connecting member 204. In an exemplary embodiment, it may be understood that when a bar is interconnected diagonally between a first member and a second member, it may mean that a first end of the bar is attached to an end of the first member and another end of the bar is attached to an opposite end of the second member.

In an exemplary embodiment, first end 262 of first slotted-bar 206 may be attached to a first end 222 of first connecting member 202. In an exemplary embodiment, second end 264 of first slotted-bar 206 may be attached to a second end 244 of second connecting member 204. In an exemplary embodiment, first end 282 of second slotted-bar 208 may be attached to a second end 224 of first connecting member 202. In an exemplary embodiment, second end 284 of second slotted-bar 208 may be attached to a first end 242 of second connecting member 204. In an exemplary embodiment, first end 222 of first connecting member 202 may be in front of first end 242 of second connecting member 204. Similarly, in an exemplary embodiment, second end 242 of first connecting member 202 may be in front of second end 244 of second connecting member 204. In an exemplary embodiment, when first end 222 of first connecting member 202 is in front of first end 242 of second connecting member 204, it may mean that a first vertical axis 251 passing through first end 222 of first connecting member 202 and first end 242 of second connecting member 204 may be perpendicular to both a main plane 252 of first horizontal plate 223 and a main plane 253 of second horizontal plate 243. In an exemplary embodiment, when second end 224 of first connecting member 202 is in front of second end 244 of second connecting member 204, it may mean that a second vertical axis 254 passing through second end 224 of first connecting member 202 and second end 244 of second connecting member 204 may be perpendicular to both a main plane 252 of first horizontal plate 223 and a main plane 253 of second horizontal plate 243.

In an exemplary embodiment, it may be understood that when first end 222 of first connecting member 202 is in front of first end 242 of second connecting member 204 and second end 242 of first connecting member 202 is in front of second end 244 of second connecting member 204, first slotted-bar 206 and second slotted-bar 208 may form an "X" shape from a side-view of friction damper 100 as a cross arrangement. In other words, when first end 222 of first connecting member 202 is in front of first end 242 of second connecting member 204 and second end 242 of first connecting member 202 is in front of second end 244 of second connecting member 204, a main longitudinal axis of first slotted-bar 206 and a main longitudinal axis of second slotted-bar 208 may intersect with each other. With further reference to FIG. 2C, in an exemplary embodiment, the main longitudinal axis of first slotted-bar 206 may coincide a first axis 269. In an exemplary embodiment, first axis 269 may refer to first slotted-bar's 206 axis of symmetry. In an exemplary embodiment, the main longitudinal axis of second slotted-bar 206 may coincide a second axis 289. In an exemplary embodiment, second axis 289 may refer to second slotted-bar's 208 axis of symmetry.

In an exemplary embodiment, first end 262 of first slotted-bar 206 may be attached rotatably to first end 222 of first connecting member 202 by utilizing a first pin mechanism. In an exemplary embodiment, the first pin mechanism may include a first pin 226 attached to first end 262 of first slotted-bar 206. In an exemplary embodiment, the first pin mechanism may further include a first pin receiving hole 266 at a first end 262 of first slotted-bar 206. In an exemplary embodiment, in order to attach first end 262 of first slotted-bar 206 to first end 222 of first connecting member 202, first pin 226 may be disposed inside first pin receiving hole 266. In an exemplary embodiment, the first pin mechanism may allow first slotted-bar 206 to rotate around a centerline of first pin 226. In an exemplary embodiment, the centerline of first pin 226 may refer to an axis that passes through centers of two bases of first pin 226.

In an exemplary embodiment, first end 282 of second slotted-bar 208 may be attached rotatably to second end 224 of first connecting member 202 by utilizing a second pin mechanism. In an exemplary embodiment, the second pin mechanism may include a second pin 226 attached to first end 282 of second slotted-bar 208. In an exemplary embodiment, the second pin mechanism may further include a second pin receiving hole 286 at first end 282 of second slotted-bar 208. In an exemplary embodiment, in order to attach first end 282 of second slotted-bar 208 to second end 224 of first connecting member 202, second pin 228 may be disposed inside second pin receiving hole 286. In an exemplary embodiment, the second pin mechanism may allow second slotted-bar 208 to rotate around a centerline of second pin 228. In an exemplary embodiment, the centerline of second pin 228 may refer to an axis that passes through centers of two bases of second pin 228.

In an exemplary embodiment, second end 264 of first slotted-bar 206 may be attached slidably and rotatably to second end 244 of second connecting member 204 by utilizing a first slider mechanism. In an exemplary embodiment, the first slider mechanism may include a third pin 246 attached to second end 264 of first slotted-bar 206. In an exemplary embodiment, the first slider mechanism may further include a first slot 268 at a second end 264 of first slotted-bar 206. In an exemplary embodiment, in order to attach second end 264 of first slotted-bar 206 to first end 222 of first connecting member 202, third pin 246 may be disposed inside first slot 268. In an exemplary embodiment, the first slider mechanism may allow first slotted-bar 206 to rotate around a centerline of third pin 246. In an exemplary embodiment, the centerline of third pin 246 may refer to an axis that passes through centers of two bases of third pin 246. In an exemplary embodiment, the first slider mechanism may further allow first slotted-bar 206 to move linearly along a first axis 269. In an exemplary embodiment, first axis 269 may refer to first slotted-bar's 206 axis of symmetry.

In an exemplary embodiment, second end 284 of second slotted-bar 208 may be attached slidably and rotatably to first end 242 of second connecting member 204 by utilizing a second slider mechanism. In an exemplary embodiment, the second slider mechanism may include a fourth pin 248 attached to second end 284 of second slotted-bar 208. In an exemplary embodiment, the second slider mechanism may further include a second slot 288 at second end 284 of second slotted-bar 208. In an exemplary embodiment, in order to attach second end 284 of second slotted-bar 208 to first end 242 of second connecting member 204, fourth pin 248 may be disposed inside second slot 288. In an exemplary embodiment, the second slider mechanism may allow second slotted-bar 208 to rotate around a centerline of fourth pin 248. In an exemplary embodiment, the centerline of fourth pin 248 may refer to an axis that passes through centers of two bases of fourth pin 248. In an exemplary embodiment, the second slider mechanism may further allow second slotted-bar 208 to move linearly along a second axis 289. In an exemplary embodiment, second axis 289 may refer to second slotted-bar's 208 axis of symmetry.

Figure 3:
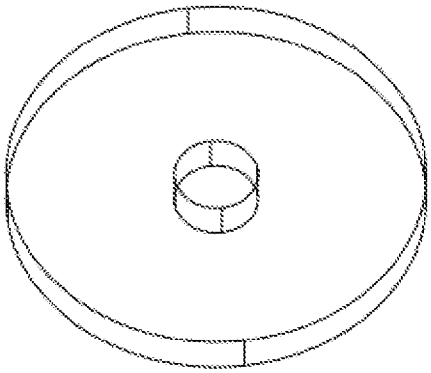
FIG. 3 illustrates a perspective view of an exemplary first frictional member, consistent with one or more exemplary embodiments of the present disclosure.

In an exemplary embodiment, friction damper 100 may further include a first frictional mechanism. In an exemplary embodiment, the first frictional mechanism may resist against movements of first slotted-bar 206 by developing a friction force between the first frictional mechanism and first slotted-bar 206. In an exemplary embodiment, the first frictional mechanism may include a first frictional member 207 and a first fastening member 272. In an exemplary embodiment, first frictional member 207 may be disposed next to first slotted-bar 206 and in contact with first slotted-bar 206. In an exemplary embodiment, first fastening member 272 may be configured to increase and/or decrease a normal force between first frictional member 207 and first slotted-bar 206. In an exemplary embodiment, first fastening member 272 may include a nut with an internally threaded section. In an exemplary embodiment, when first fastening member 272 is tightened, first frictional member 207 may exert a greater normal force to first slotted-bar 206, and consequently, a greater friction force may be developed between first frictional member 207 and first slotted-bar 206. In an exemplary embodiment, when first fastening member 272 is loosened, first frictional member 207 may exert a smaller normal force to first slotted-bar 206, and consequently, a smaller friction force may be developed between first frictional member 207 and first slotted-bar 206. In an exemplary embodiment, the developed friction force between first frictional member 207 and first slotted-bar 206 may resist against movements of first slotted-bar 206. In an exemplary embodiment, first frictional member 207 may have a disc shape. FIG. 3 shows a perspective view of first frictional member 207, consistent with one or more exemplary embodiments of the present disclosure. In an exemplary embodiment, first frictional member 207 may be mounted onto third pin 246 and adjacent to first slotted-bar 206. In an exemplary embodiment, it may be understood that when first slotted-bar 206 is urged to move relative to second connecting member 204, a first friction force may arise between first slotted-bar 206 and second connecting member 204. In an exemplary embodiment, the first friction force may resist against movements of first slotted-bar 206 relative to second connecting member 204.

In an exemplary embodiment, first fastening member 272 may be mounted onto third pin 246 and adjacent to first frictional member 207. In an exemplary embodiment, first fastening member 272 may secure first frictional member 207 constantly in contact with first slotted-bar 206. In an exemplary embodiment, first fastening member 272 may include a first nut. In an exemplary embodiment, the first nut may be tightened on third pin 246. In an exemplary embodiment, it may be understood that by tightening the first nut on third pin 246, first frictional member 207 may exert a first normal force to first slotted-bar 206. In an exemplary embodiment, it may be understood by tightening the first nut on third pin 246 more tightly, the first normal force may increase due to the fact that by tightening the first nut on third pin 246 more tightly, the first nut may push first frictional member 207 toward first slotted-bar 206 more intensely. In an exemplary embodiment, it may be understood that greater first normal force may mean that a more intense vibration of first connecting member 202 and second connecting member 204 may be needed to be able to cause first slotted-bar 206 to move. In an exemplary embodiment, when a greater normal force is developed between first slotted-bar 206 and first frictional member 207, the friction force between first slotted-bar 206 and first frictional member 207 and, consequently, a greater force may be able to overcome the friction force between first slotted-bar 206 and first frictional member 207, and may therefore, cause first slotted-bar 206 to move. In an exemplary embodiment, friction damper 100 may further include a second frictional mechanism. In an exemplary embodiment, the second frictional mechanism may be similar in structure and functionality to the first frictional mechanism. In an exemplary embodiment, the second frictional mechanism may resist against movements of second slotted-bar 208 by developing a friction force between the second frictional mechanism and second slotted-bar 208. In an exemplary embodiment, the second frictional mechanism may include a second frictional member 209 and a second fastening member 292. In an exemplary embodiment, second frictional member 209 may be disposed next to second slotted-bar 208 and in contact with second slotted-bar 208. In an exemplary embodiment, second fastening member 272 may be configured to increase and/or decrease a normal force between first frictional member 207 and first slotted-bar 206. In an exemplary embodiment, first fastening member 292 may include a nut with an internally threaded section. In an exemplary embodiment, when second fastening member 292 is tightened, second frictional member 209 may exert a greater normal force to second slotted-bar 208, and consequently, a greater friction force may be developed between second frictional member 209 and second slotted-bar 208. In an exemplary embodiment, when second fastening member 292 is loosened, second frictional member 209 may exert a smaller normal force to second slotted-bar 208, and consequently, a smaller friction force may be developed between second frictional member 209 and second slotted-bar 208. In an exemplary embodiment, the developed friction force between second frictional member 209 and second slotted-bar 208 may resist against movements of second slotted-bar 208. In an exemplary embodiment, second frictional member 209 may have a disc shape. In an exemplary embodiment, second frictional member 209 may be similar in shape and functionality to first frictional member 207. In an exemplary embodiment, second frictional member 209 may be mounted onto fourth pin 248 and adjacent to second slotted-bar 208. In an exemplary embodiment, it may be understood that when second slotted-bar 208 is urged to move relative to second connecting member 204, a second friction force may arise between second slotted-bar 208 and second connecting member 204. In an exemplary embodiment, the second friction force may resist against movements of second slotted-bar 208 relative to second connecting member 204.

In an exemplary embodiment, second fastening member 292 may be mounted onto fourth pin 248 and adjacent to second frictional member 209. In an exemplary embodiment, second fastening member 292 may secure second frictional member 209 constantly in contact with second slotted-bar 208. In an exemplary embodiment, second fastening member 292 may include a second nut. In an exemplary embodiment, the second nut may be tightened on fourth pin 248. In an exemplary embodiment, it may be understood that by tightening the second nut on fourth pin 248, second frictional member 209 may exert a second normal force to second slotted-bar 208. In an exemplary embodiment, it may be understood by tightening the second nut on fourth pin 248 more tightly, the second normal force may increase due to the fact that by tightening the second nut on fourth pin 248 more tightly, the second nut may push second frictional member 209 toward second slotted-bar 208 more intensely. In an exemplary embodiment, it may be understood that the higher second normal force may mean that a more intense vibration of s connecting member 202 and second connecting member 204 may be needed to be able to cause second slotted-bar 208 to move. In an exemplary embodiment, when a greater normal force is developed between second slotted-bar 208 and second frictional member 209, the friction force between second slotted-bar 208 and second frictional member 209 and, consequently, a greater force may be able to overcome the friction force between second slotted-bar 208 and second frictional member 209 and cause second slotted-bar 208 to move.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective spaces of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A friction damper for attenuating vibrations of a structure, the friction damper comprising:

a first connecting member configured to be attached to a first member of the structure;

a second connecting member configured to be attached to a second member of the structure;

a first slotted-bar interconnected between the first connecting member and the second connecting member, a first end of the first slotted-bar attached rotatably to the first connecting member, a second end of the first slotted-bar attached rotatably and slidably to the second connecting member; and a second slotted-bar interconnected between the first connecting member and the second connecting member, a first end of the second slotted-bar attached rotatably to the first connecting member, a second end of the second slotted bar attached rotatably and slidably to the second connecting member, wherein:

the first slotted-bar and the second-slotted bar are configured to allow horizontal and vertical movements of the first connecting member and the second connecting member relative to each other responsive to vibration of the structure;

the first end of the first slotted-bar is attached rotatably to a first end of the first connecting member;

the first end of the second slotted-bar is attached rotatably to a second end of the first connecting member;

the second end of the second slotted-bar is attached rotatably and slidably to a first end of the second connecting member;

the second end of the first slotted-bar is attached rotatably and slidably to a second end of the second connecting member;

the first end of the first connecting member is in front of the first end of the second connecting member and the second end of the first connecting member is in front of the second end of the second connecting member, a main longitudinal axis of the first slotted-bar intersecting a projection of a main longitudinal axis of the second slotted-bar on a main plane of the first slotted-bar, the main longitudinal axis of the first slotted-bar coinciding with a longest dimension of the first slotted-bar, the main longitudinal axis of the second slotted-bar coinciding with a longest dimension of the second slotted-bar, the main plane of the first slotted-bar coinciding with a largest surface of the first slotted-bar and passing through the main longitudinal axis of the first slotted-bar;

the first end of the first connecting member is in front of the first end of the second connecting member comprises a first vertical axis passing through the first end of the first connecting member and the first end of the second connecting member being perpendicular to both a main plane of a first horizontal plate of the first connecting member and a main plane of a second horizontal plate of the second connecting member;

the second end of the first connecting member is in front of the second end of the second connecting member comprises a second vertical axis passing through the second end of the first connecting member and the second end of the second connecting member being perpendicular to both the main plane of the first horizontal plate of the first connecting member and the main plane of the second horizontal plate of the second connecting member;

the second end of the first slotted-bar is attached rotatably and slidably to the second end of the second connecting member utilizing a first slider mechanism, the first slider mechanism comprising:

a first pin attached to the second end of the second connecting member; and a first pin receiving slot at the second end of the first slotted-bar, the first pin disposed slidably inside the first pin receiving slot; and the second end of the second slotted-bar is attached rotatably and slidably to the first end of the second connecting member utilizing a second slider mechanism, the second slider mechanism comprising: 'a second pin attached to the first end of the second connecting member; and a second pin receiving slot at the second end of the second slotted-bar, the second pin disposed slidably inside the second pin receiving slot.

2. The friction damper of claim 1, wherein:

the first end of the first slotted-bar is attached rotatably to the first end of the first connecting member utilizing a first pin mechanism, the first pin mechanism comprising:

a third pin attached to the first end of the first connecting member; and a first pin receiving hole at the first end of the first slotted-bar, the third pin disposed inside the first pin receiving hole; and the first end of the second slotted-bar is attached rotatably to the second end of the first connecting member utilizing a second pin mechanism, the second pin mechanism comprising:

a fourth pin attached to the second end of the first connecting member; and a second pin receiving hole at the first end of the second slotted-bar, the fourth pin disposed inside the second pin receiving hole.

3. The friction damper of claim 2, further comprising:

a first frictional mechanism configured to resist against movement of the first slotted-bar relative to the second member through arising a first friction force between the first frictional mechanism and the first slotted-bar, the first frictional mechanism comprising:

a first frictional member mounted onto the third pin and adjacent to the first slotted-bar, the first frictional member configured to arise the first friction force between the first slotted-bar and the first frictional member responsive to movement of the first slotted-bar; and a first fastening member mounted onto the third pin and adjacent to the first frictional member, the first fastening member configured to secure the first frictional member constantly in contact with the first slotted-bar; and a second frictional mechanism configured to resist against movement of the second slotted-bar through arising a second friction force between the second frictional mechanism and the second slotted-bar, the second frictional mechanism comprising:

a second frictional member mounted onto the fourth pin and adjacent to the second slotted-bar, the second frictional member configured to arise the second friction force between the second slotted-bar and the second frictional member responsive to movement of the first slotted-bar; and a second fastening member mounted onto the fourth pin and adjacent to the second frictional member, the second fastening member configured to secure the second frictional member constantly in contact with the second slotted-bar.

4. The friction damper of claim 3, wherein:

the first connecting member comprises:

a first horizontal plate configured to be attached to the first member of the structure from a top surface of the first horizontal plate; and a first vertical plate attached to a bottom surface of the first horizontal plate, the second connecting member comprises:

a second horizontal plate configured to be attached to the second member of the structure from a bottom surface of the second horizontal plate; and a second vertical plate attached to a top surface of the second horizontal plate, and the top surface of the second horizontal plate and the bottom surface of the first horizontal plate face toward each other.

5. The friction damper of claim 4, wherein:

a first side of the first vertical plate is aligned with a first side of the second vertical plate, and a second side of the first vertical plate is aligned with a second side of the second vertical plate.

6. The friction damper of claim 5, wherein:

the first slotted-bar is attached to the first side of the first vertical plate and the first side of the second vertical plate, and the second slotted-bar is attached to the second side of the first vertical plate and the second side of the second vertical plate.

7. A friction damper for attenuating vibrations of a structure, the friction damper comprising:

a first connecting member configured to be attached to a first member of the structure;

a second connecting member configured to be attached to a second member of the structure;

a first slotted-bar interconnected between the first connecting member and the second connecting member, a first end of the first slotted-bar attached rotatably to the first connecting member, a second end of the first slotted-bar attached rotatably and slidably to the second connecting member; and a second slotted-bar interconnected between the first connecting member and the second connecting member, a first end of the second slotted-bar attached rotatably to the first connecting member, a second end of the second slotted bar attached rotatably and slidably to the second connecting member, wherein:

the first slotted-bar and the second-slotted bar are configured to allow horizontal and vertical movements of the first connecting member and the second connecting member relative to each other responsive to vibration of the structure;

the first end of the first slotted-bar is attached rotatably to a first end of the first connecting member;

the first end of the second slotted-bar is attached rotatably to a second end of the first connecting member;

the second end of the second slotted-bar is attached rotatably and slidably to a first end of the second connecting member;

the second end of the first slotted-bar is attached rotatably and slidably to a second end of the second connecting member;

the first end of the first connecting member is in front of the first end of the second connecting member and the second end of the first connecting member is in front of the second end of the second connecting member, a main longitudinal axis of the first slotted-bar intersecting a projection of a main longitudinal axis of the second slotted-bar on a main plane of the first slotted-bar, the main longitudinal axis of the first slotted-bar coinciding with a longest dimension of the first slotted-bar, the main longitudinal axis of the second slotted-bar coinciding with a longest dimension of the second slotted-bar, the main plane of the first slotted-bar coinciding with a largest surface of the first slotted-bar and passing through the main longitudinal axis of the first slotted-bar;

the first end of the first connecting member is in front of the first end of the second connecting member comprises a first vertical axis passing through the first end of the first connecting member and the first end of the second connecting member being perpendicular to both a main plane of a first horizontal plate of the first connecting member and a main plane of a second horizontal plate of the second connecting member;

the second end of the first connecting member is in front of the second end of the second connecting member comprises a second vertical axis passing through the second end of the first connecting member and the second end of the second connecting member being perpendicular to both the main plane of the first horizontal plate of the first connecting member and the main plane of the second horizontal plate of the second connecting member;

the second end of the first slotted-bar is attached rotatably and slidably to the second end of the second connecting member utilizing a first slider mechanism, the first slider mechanism comprising:

a first pin attached to the second end of the second connecting member; and a first pin receiving slot at the second end of the first slotted-bar, the first pin disposed slidably inside the first pin receiving slot;

the second end of the second slotted-bar is attached rotatably and slidably to the first end of the second connecting member utilizing a second slider mechanism, the second slider mechanism comprising:

a second pin attached to the first end of the second connecting member; and a second pin receiving slot at the second end of the second slotted-bar, the second pin disposed slidably inside the second pin receiving slot;

the first end of the first slotted-bar is attached rotatably to the first end of the first connecting member utilizing a first pin mechanism, the first pin mechanism comprising:

a third pin attached to the first end of the first connecting member; and a first pin receiving hole at the first end of the first slotted-bar, the third pin disposed inside the first pin receiving hole; and the first end of the second slotted-bar is attached rotatably to the second end of the first connecting member utilizing a second pin mechanism, the second pin mechanism comprising:

a fourth pin attached to the second end of the first connecting member; and a second pin receiving hole at the first end of the second slotted-bar, the fourth pin disposed inside the second pin receiving hole;

the friction damper further comprises:

a first frictional mechanism configured to resist against movement of the first slotted-bar relative to the second member through arising a first friction force between the first frictional mechanism and the first slotted-bar, the first frictional mechanism comprising:

a first frictional member mounted onto the third pin and adjacent to the first slotted-bar, the first frictional member configured to arise the first friction force between the first slotted-bar and the first frictional member responsive to movement of the first slotted-bar; and a first fastening member mounted onto the third pin and adjacent to the first frictional member, the first fastening member configured to secure the first frictional member constantly in contact with the first slotted-bar; and a second frictional mechanism configured to resist against movement of the second slotted-bar through arising a second friction force between the second frictional mechanism and the second slotted-bar, the second frictional mechanism comprising:

a second frictional member mounted onto the fourth pin and adjacent to the second slotted-bar, the second frictional member configured to arise the second friction force between the second slotted-bar and the second frictional member responsive to movement of the first slotted-bar; and a second fastening member mounted onto the fourth pin and adjacent to the second frictional member, the second fastening member configured to secure the second frictional member constantly in contact with the second slotted-bar;

the first connecting member comprises:

a first horizontal plate configured to be attached to the first member of the structure from a top surface of the first horizontal plate; and a first vertical plate attached to a bottom surface of the first horizontal plate, the second connecting member comprises:

a second horizontal plate configured to be attached to the second member of the structure from a bottom surface of the second horizontal plate; and a second vertical plate attached to a top surface of the second horizontal plate;

the top surface of the second horizontal plate and the bottom surface of the first horizontal plate face toward each other;

a first side of the first vertical plate is aligned with a first side of the second vertical plate;

a second side of the first vertical plate is aligned with a second side of the second vertical plate;

the first slotted-bar is attached to the first side of the first vertical plate and the first side of the second vertical plate, and the second slotted-bar is attached to the second side of the first vertical plate and the second side of the second vertical plate.

* * * * *